US008946530B1

(12) United States Patent
Karapetyan

(10) Patent No.: US 8,946,530 B1
(45) Date of Patent: Feb. 3, 2015

(54) HAND-OPERATED CLAPPING PERCUSSION AND RHYTHM DEVICE WITH CONTROLLABLE TONE OF SOUND

(71) Applicant: Armen Karapetyan, Los Angeles, CA (US)

(72) Inventor: Tigran Karapetyan, Los Angeles, CA (US)

( * ) Notice: Subject to any disclaimer, the term of this patent is extended or adjusted under 35 U.S.C. 154(b) by 251 days.

(21) Appl. No.: 13/694,704

(22) Filed: Dec. 26, 2012

(51) Int. Cl.
*G10D 13/08* (2006.01)

(52) U.S. Cl.
CPC ..... *G10D 13/08* (2013.01)
USPC ..... 84/402

(58) Field of Classification Search
CPC ..... G10K 3/00; G10D 13/00; G10D 13/06
USPC ..... 84/402; 446/418, 422; D21/405
See application file for complete search history.

(56) References Cited

U.S. PATENT DOCUMENTS 1,478,399 A 12/1923 Rothschild
1,890,288 A 12/1932 Graf
3,019,553 A 2/1962 Gomez et al.
3,059,375 A 10/1962 Tischer
3,157,000 A 11/1964 Stavig
3,444,772 A * 5/1969 Martin ..... 84/402
3,909,977 A 10/1975 Kirk
4,019,277 A 4/1977 Kenkelen
4,075,922 A 2/1978 Smith
4,149,444 A 4/1979 Parsons
4,266,459 A * 5/1981 Seregely ..... 84/402
5,323,678 A 6/1994 Yould
5,431,069 A * 7/1995 Davis ..... 76/87
6,011,206 A 1/2000 Straley
6,091,009 A 7/2000 Simons et al.
6,686,524 B2 2/2004 Hirayama
7,518,050 B2 4/2009 Stannard

* cited by examiner

*Primary Examiner* — Jianchun Qin

(57) ABSTRACT

This invention, hand-operated clapping percussion and rhythm device with controllable tone of sound, provides the hand-operated percussion and rhythm device, producing the different tone of trembled sound. An improved hand-operated clapping percussion and rhythm device with controllable tone of sound comprises at least two of a plurality of blades rigidly tightened in the area of the handle portion by the tightening device and the tone of sound control device located in the lower portion of the blade portion, which includes the rest, nut, rigidly secured in the appropriate blade, and the regulator controlling the different gaps' size between the appropriate blades.

3 Claims, 7 Drawing Sheets

38-38

38-38

38-38

VIEW
39-39

40-40

HAND-OPERATED CLAPPING PERCUSSION AND RHYTHM DEVICE WITH CONTROLLABLE TONE OF SOUND

CROSS-REFERENCE TO RELATED APPLICATION

Not Applicable

STATEMENT REGARDING FEDERALLY SPONSORED RESEARCH OR DEVELOPMENT

Not Applicable

THE NAME OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The invention relates to the hand-operated clapping percussion and rhythm device with controllable tone of sound, and more particularly, to the percussion and rhythm hand-operated device providing variety tone of clapping/slapping sound produced by reciprocating clapping motion.

(2) Description of Related Art Including Information Disclosed Under 37 CFR 1.97 and 1.98

There are many known devices producing sounds. Some sound providing devices produce musical sound, clapping or slapping sound, or noise for fan, etc.

For example, musical instrument—ribbon harp by U.S. Pat. No. 6,011,206 is a mouth-blown musical instrument consisting of a thin ribbon-like textile or polymeric object. When held between the thumbs and blown on by mouth, the ribbon harp vibrates in the audible frequency range and produces a musical note. The player may vary the tension in the ribbon in order to vary the fundamental frequency with which the ribbon harp vibrates, thus producing higher or lower pitches. Various methods may be used to provide lengthwise strength. Dampening properties can be tuned by varying properties in the crosswise direction. Aerodynamic surface treatments are provided so that the ribbon harp commences to vibrate immediately on being blown across. A wrist harness or gauntlet and a thumb cot are described as aids to the player.

The length of the ribbon harp is typically 35 cm. Players may trim the ribbon to length for convenience. The width of the ribbon varies from 1 to 10 mm; typically 2.5 to 7 mm. The ribbon has varied weight per length. In woven ribbon harps this is controlled by several factors such as width, density of weave, thread characteristics, and resin characteristics. In ribbon harps of primarily single polymeric materials weight per length is controlled by volume per length and polymer density. Weight per length is a critical factor for control of the fundamental frequency. Weight per length varies from 0.01 grams/cm to 2 grams/cm, with varied weight classes selected for the desired voice. Ribbon harps made primarily of a single polymeric material may be made with no aerodynamic asymmetry or surface treatment, and also with no longitudinal reinforcement. This is the simplest form of the ribbon harp. A ribbon harp made primarily of a polymeric material may have longitudinal reinforcement. A few strong fibers may be imbedded in the polymeric material. These fibers provide added strength in the longitudinal, or lengthwise, direction.

Ribbon harps made primarily of a single polymeric material includes an asymmetric planar surfaces, pits, small bumps, a ribbed or striated surface which is created by the extrusion die, the crosswise fibers, the loop at one end of the ribbon is simply formed and sewed back onto itself, and other additional appropriate elements and means.

Such devices require the extensive experience.

The other percussion instrument disclosed in the U.S. Pat. No. 7,518,050 describes the folded percussion instrument comprising a cymbal, wherein the instrument is formed with a bent or folded area along one or more lines, planes, or curves of the instrument resulting in the creation of equal or unequal distinct sections.

Cymbals have small flanged edges in the past but the edge was a continuous circular flange which encircled the entire edge of the cymbal, as opposed to interrupted edges directed at portions/parts of the outside edges having unbent areas. This increases the rigidity of the cymbal markedly by creation of an outer structural stiffening rib. The circular or geometrically shaped cymbals are bent along lines or isolated areas to create geometric shapes in which the outer rib is interrupted at the termination point of each bend. This creates an area in the unbent areas of greater flexibility. The areas of greater flexibility in combination with the bent (more rigid) areas create altered, multiple modes of vibration. In addition, striking the cymbal directly against the bent edge will sound different than striking the unbent edge. The edge, being rounded and presenting a broader surface to the drumstick, produces a new sound. This bent area also presents a much broader contact point to the drumstick and hence helps preserve the stick in a motion called "slicing" whereby the stick strikes directly at 90° to the edge of the cymbal. In a conventional cymbal, slicing at high impact force is not recommended. It can cause cracking of the cymbal and of shredding the drumstick. It also yields a weak tone as it mostly excites longitudinal vibrations. Slicing in conventional cymbals is limited to low impact, "special effects" sounds. In this invention, slicing neither leads to stick wear or cymbal cracking. Slicing, hence can now become a viable form of striking of the cymbal. The sound produced can be of very fast attack with very little swell, but with a great degree of overtone complexity.

The different shapes of the instrument are possible, e.g., square form, etc.

The instruments of such type are wide known and require the specific expensive materials for their manufacturing. The percussion instrument by U.S. Pat. No. 6,686,524 produces the drum sounds. The instrument includes a barrier with an opening guides a drum player to strike a drumhead in predetermined areas. The barrier may be supported by the rim of the drum and may have a limited effect on the sound quality and volume of the drum playing.

The rhythm or noise making instrument—shaker by U.S. Pat. No. 6,555,736. The shaker has a shell that envelops a hollow interior that contains a number of percussive particles. There is also provided a sound dampening insert that covers all but a portion of the interior surface of the shell. The rhythm shaker's shell has only one surface on which the enclosed sound producing material can strike the shell and make a sound. The remainder of the shell's surfaces are protected or covered with the sound dampening insert that mutes or dampens the sound by preventing the sound producing material from striking against the interior surface of the shell.

The instrument includes a dampening insert or container, a shell that is adapted to sleeve over the insert, and a pair of end caps that are adapted to enclose the insert in the sleeve. The shaker is rectangular in shape. The dampening insert is also rectangular in shape with one long side surface forming an opening. Shell has a square cross-sectional shape and shell corresponds generally to the overall shape and dimensions of insert, but is slightly larger in circumference in order to sleeve over the insert. The shell has a hollow body with four closed or connected side surfaces, and two open ends. However, in alternative embodiments, shell can have one open end and a corresponding one end cap. Also, shell has a nominal wall thickness. Such a nominal wall thickness is about 0.5 millimeters (mm) to about 2.5 mm in thickness. Dampening insert is removably inserted into shell. Percussive media is placed in dampening insert through opening. Opening of dampening insert is positioned to face one closed side surfaces of shell. End caps are then inserted into end surfaces to seal off or close shell. Shell envelops dampening insert, the cavity inside the hollow body, and the percussive media. The caps are inserted into end surfaces of shell to form a sealed surface on the shell.

The other shaker is described in the U.S. Pat. No. 5,323,678. This hand-held percussion musical instrument in the form of a rigid tubular ring, which includes a plurality of elongate hollow tubes, the tubes having rigid tubular walls and opposite end walls defining closed hollow tube interiors. Steel shot is loosely contained within the hollow interiors of the tubes, whereby the ring may be hand manipulated to cause the shot to impact the walls to create audible percussion sounds. The rigid tubular ring about a central axis by an upper ring half and a lower ring half which join together about the full circumference of the ring in a median plane which is approximately coincident with the inner and outer circumferential lines of joinders between the upper and lower halves, such that the median plane approximately bisects the ring along and through its total circumference.

The tubular ring is in the form of a regular hexagon and includes six identical, straight elongate hollow tubes respectively defined by smooth tubular walls of circular cross-section each about a separate central longitudinal tube axes. Common end walls close the opposite ends of the hollow tubes, with the tubes thereby each having a separate hollow interior. The hollow tubes are effectively connected end-to-end adjacent the end walls to form the hexagonal tubular ring. The tubular member bends upon itself to form a closed figure, such as a hexagon. The contained within the separate hollow tubes defined by the smooth tubular walls are separate pluralities of metallic steel shot, each pellet of steel shot being approximately spherical. The upper and lower halves of the tubular ring are each formed in a single piece by injection molding of a hard, rigid plastic material such as polycarbonate or acrylic plastic. Steel shot is first introduced in the open bottom ring half, the mating surfaces of the upper and lower ring halves are then wetted with a conventional volatile solvent for the plastic selected, and the two ring halves are then pressed together so that their mating surfaces weld together.

The U.S. Pat. No. 7,750,218 discloses a vibrato based percussion instrument. The instrument is configured as a single two-dimensional curve, or a primary curve which is deeper or more pronounced than secondary curves along the surface of said instrument, and wherein said primary curve facilitates an oscillating flexing motion which produces an increase in the amplitude of the lowest frequency mode of vibration, the low pitch frequency modulates the whole of the spectrum of a musical sound by repeatedly raising and lowering said spectrum of sound in a periodic or oscillating manner, this effect being defined here as "vibrato". The instrument is suspended from one or more points, by means of an instrument supporting member or mounting device, rigid or flexible. The suspension or mounting points approximate the nodal area of the instrument.

The musical percussion instrument, described in the U.S. Pat. No. 6,091,009, is a an idiophone musical instrument having at least one "agogo" bell and a handle or bracket. The bell has an oval, elliptical or rounded shape with a pair of opposed slits, and is formed of plastic. A mounting construction for the bell includes a multisided aperture formed in the bell's body and a mating multisided stem extending from the handle or bracket. The mounting construction prevents twisting even during playing, and permits a choice of different physical orientations of playing positions of the bell.

Agogo chamber has a body with a wall. Body extends in an axial direction between a first end and a second end. Wall has a first portion that extends from first end to a plane, and a second portion that extends from plane to second end. Wall has uniform dimensions throughout first portion, and has tapered dimensions in second portion. The wall tapers in second portion from plane toward second end. The wall is shaped to define a resonating chamber within body. The wall has an outer surface and an inner surface. Outer and inner surfaces are each generally oval, elliptical or round shaped in cross-section transverse of axial direction. The outer surface has a substantially elliptical shape, and inner surface has a non-elliptical shape. Elliptical shape of outer surface reduces the amount of material and provides a better striking surface than other shapes. The wall has first slot and second slot. First and second slots are situated on opposite sides of body along major axis length in first portion. First and second slots extend in axial direction along first portion from first end towards, but not to second end. The depth of each slot in first portion affects the sound of the agogo chamber.

These sound making percussion devices are mostly musical sound instruments or shakers.

The other kind of the analogous sound producing devices are the clapping/slapping devices.

For instance, there are known noise-making devices: wooden musical toy by U.S. Pat. No. 3,019,553, snap gun by U.S. Pat. No. 1,890,288, noise-making paddle by U.S. Pat. No. 3,157,000, fan by U.S. Pat. No. 1,478,399, and the combined fan and noisemaker by U.S. Pat. No. 4,019,277. The combined fan and noisemaker described in the U.S. Pat. No. 4,019,277 generally includes a central anvil blade and juxtaposed outer blades, protuberances on the outer blade for percussively engaging the anvil blade, and means for pivotably securing together the outer and anvil blades, whereby the outer blades may be pivoted to an open fan-like disposition or may be aligned in juxtaposed relationship so that said outer blades may be percussively struck on said anvil blade.

Specifically, the combined fan and noisemaker comprises a pair of outer blades and an intermediate anvil blade. The blades are joined together by the rivet, with the outer blade being spaced from the anvil blade by the spacer, and the outer blade being spaced from the anvil blade by the another spacer. The outer blades may are formed of flexible plastic, such as polyethylene. The outer blade is provided with a protuberance and the outer blade is provided with another protuberance. These protuberances are integral with the blades and extend outwardly a distance which is greater than the width of the spacers. The protuberances face the juxtaposed faces of the anvil blade. The protuberances are positioned on the order of a half to one and a half inches below the outermost ends of the outer blades. The combined fan and noisemaker is used as a fan when the outer blades are pivoted to either side of the anvil blade.

The rhythm instrument disclosed in the U.S. Pat. No. 4,149,444 claims device utilizing sound producing element combinations for the bass, tom-tom and snare sections of an electronic drum to provide an advantageous audio reproduction of the sounds of conventional drums. The sounding elements provide more accurate snap, staccato, roll, and rim sounds. The audio producing mechanisms generally include dynamic impact between an extended vibrationally displaceable element secured on opposing ends thereof to a base surface and a resilient band stretched across an upper surface of the vibrational element. Sounds are produced by causing a striker arm having a hard tip portion member to impinge upon the resilient band causing it in turn to strike the displaceable element. A bass sound is provided by a single such unit utilizing a wide metal strip as the displaceable element. Tom-tom sounds are provided by multiple units having wires of varying lengths utilized as the vibrationally displaceable element with the widths being more narrow than that of the bass unit. A single unit using a plurality of metal wires tightly drawn at one end and fanned at its other end provide snare sounds.

Specifically, the vibrating and primary sound producing member of bass means is vibrationally displaceable element extending in a longitudinal direction. Vibrational element is a planar in contour and extends substantially parallel to base. Vibrationally displaceable element is secured to support block elements on opposing longitudinal ends thereof. Support block elements are secured in fixed relation to base surface. Support block elements are also utilized as damping mechanisms for damping vibrational displacements. Support blocks include central region formed of a resilient or pliant composition such as rubber or some like material. The opposing longitudinal ends of strip or plate element are partially embedded into this central pliant region in secured manner. In this manner, blocks furnish both support for strip element and damping to gradually attenuate the vibrations of strip after such is dynamically impacted.

This rhythm instrument is complex, expensive, and requires the extensive experience for use.

According to U.S. Pat. No. 4,266,459, the asynchronous slapping musical instrument for slapping sounds occurring at an audibly distinct asynchronous rate. The instrument generally includes a rigid slat member having a plurality of flexible slat members disposed adjacent thereto on at least one side and connected at one end to form a gripping handle. The flexible slats are increasingly weighted away from the rigid slat member such that when the rigid slat is rapidly accelerated through a swinging motion by gripping the handle the outermost slats is flexed a greater distance than the inner slats. The time for unflexing when the swinging has stopped is greater for the outer flexible slats whereby they strike in a slapping motion at a sufficiently delayed time to be audibly distinguishable.

Specifically, the device comprises a rigid slat member having two pairs of substantially identical resiliently flexible slat members disposed with two on either side of member, the members which are clamped together between two handle members as with rivets to form a handle portion. The rigid slat member and handle members were made from one-fourth inch plywood and resiliently flexible slat members were made from 3/32-inch thick polyethylene plastic. The two outermost slat members have metallic weights attached on the outside thereof on the end furthest from handle portion.

When the handle portion is gripped and the instrument rotated in a reciprocal manner, the flexible slat members on opposite sides of the rigid slat member will be subjected to alternate equal accelerations. Since the force imparted is equal to the mass times the acceleration, with equal accelerations, the flexible slat members are subjected to differing flexing forces due to the addition of the metallic weights (e.g. mass). When the swinging is stopped, the resilient flexible slat members being flexed are tend to resume their position against the rigid slat member. Having been flexed considerably further, however, the outer slat member takes an additional time to reach and strike the inner flexible slat member and rigid slat member is sufficient to be audibly discernible.

The U.S. Pat. Nos. 3,059,375 and 4,075,922, as well as described hereinabove U.S. Pat. No. 4,266,459, have the common element—non-movable central blade (a.k.a. rigid slat member, etc.).

The decorative percussion rhythm instrument and noise-maker by U.S. Pat. No. 4,075,922 generally comprises a stiff central blade and adjacent thinner blades of flexible sheet material whose lower ends are held in closely juxtaposed stacked relationship by the user and whose upper ends are free to flex and bend as the user imparts flapping movement to the device. The flexible outer blades rhythmically swing away from the stiff central blade and swing back to strike it briskly with a sharp impact. The multiple impacts of the plurality of flexible blades are employed by the user to create a sounds, ranging from soft brushing or rattling sounds to More particularly, the instrument comprises a group of five juxtaposed clapper blades. These include a relatively thick and rigid central ("drum") blade flanked by a pair of thin, flexible clapper blades, which are each sandwiched between the drum blade and an outer cover blade of intermediate thickness, somewhat thicker than the flexible clapper blades, but thinner than the stiff drum blade. Two thin, flexible clapper blades are employed on each side of the device in this inter-sandwiched position, between the relatively rigid drum blade and each outer flexible cover blade. The grommet joins the juxtaposed and stacked lower ends of the assembled clapper blades which may be identified as the handle portions.

The known noise-making clapper by U.S. Pat. No. 3,909,977, includes a stack of three (or more) elongated, flexible blades which are rigidly secured together at a first end, and wherein each blade has a length different from the other blades and the blades are arranged in the stack in order of their successively increasing overall lengths or all the blades have the same length, but the blades are successively located in the stack such that at each end, the blades have a longitudinally overlapping arrangement, thereby, in the both variants other ends of the blades have an increasing stepped relationship. In use, the user holds the clapper in one of his hands and places his thumb over specific indicia and bends the plurality of blades arcuately backward using his thumb as a fulcrum. The noise is produced by releasing succeeding ones of blades.

The deficiency of this device is necessity to use the other hand's thumb to bend arcuately backward using the person's thumb of the other hand as a fulcrum.

All these devices have some deficiencies—they are complex and/or expensive and/or require the extensive experience to properly use them, etc.

Therefore, the mentioned known instruments and devices have the described above deficiencies which are eliminated in the improved hand-operated clapping percussion and rhythm device with controllable tone of sound.

While the mentioned above prior art fulfill their respective, particular objectives and requirements, the mentioned inventions do not disclose, teach and/or suggest the hand-operated clapping percussion and rhythm device with controllable tone of sound including the non-complex and non-expensive elements (components/parts) providing control of a tone of the produced sound.

Those skilled in the art will readily observe that numerous modifications and advantages of the improved hand-operated clapping percussion and rhythm device with controllable tone of sound may be made while retaining the teachings of the invention.

Thus, the known prior art do not provide the efficient, satisfied, convenient hand-operated clapping percussion and rhythm device with controllable tone of sound according to the present invention substantially departs from the devices of the prior art.

BRIEF SUMMARY OF THE INVENTION

In view of the foregoing disadvantages inherent in the known prior art, the present invention provides an improved hand-operated clapping percussion and rhythm device with controllable tone of sound. As such, the general purpose of the present invention, which will be described hereinafter in greater details, is to provide the hand-operated percussion and rhythm device, producing the different tone of sound, which has many of the advantages of the hand-operated clapping percussion and rhythm device with controllable tone of sound mentioned heretofore and many novel features that result in the musical pleasure, which is not anticipated, rendered obvious, suggested or even implied by any of prior art methods and percussion and rhythm devices, either alone or in any combination thereof.

To attain this, the present invention generally comprises at least two of a plurality of blades rigidly tightened in the area of the handle portion by the tightening means and the tone of sound control means located in the lower portion of the blade portion, which includes the rest, nut, rigidly secured in the appropriate blade, and the regulator controlling the different gaps' size between the appropriate blades.

Accordingly, several objects and advantages of the present invention are to provide the improved hand-operated clapping percussion and rhythm device with controllable tone of sound:

It is another object of the invention to provide a non-complex hand-operated clapping percussion and rhythm device.

It is further object of the invention to provide a non-expensive hand-operated clapping percussion and rhythm device It is still another object of the invention to eliminate the necessity of the training and extensive experience of the user to operate the clapping/slapping percussion and rhythm devices.

It is yet object of the invention to provide a control of the tone of the sound produced by the clapping/slapping percussion and rhythm devices

BRIEF DESCRIPTION OF THE SEVERAL VIEWS OF THE DRAWING(S)

The improved hand-operated clapping percussion and rhythm device with controllable tone of sound may be mentioned hereinbelow as the percussion and rhythm device or improved device or device.

In order that the invention and the manner in which it is to be performed may be more clearly understood, embodiments thereof will be described by way of example with reference to the attached drawings, of which:

THE DRAWING REFERENCE NUMERALS

Figure 1:
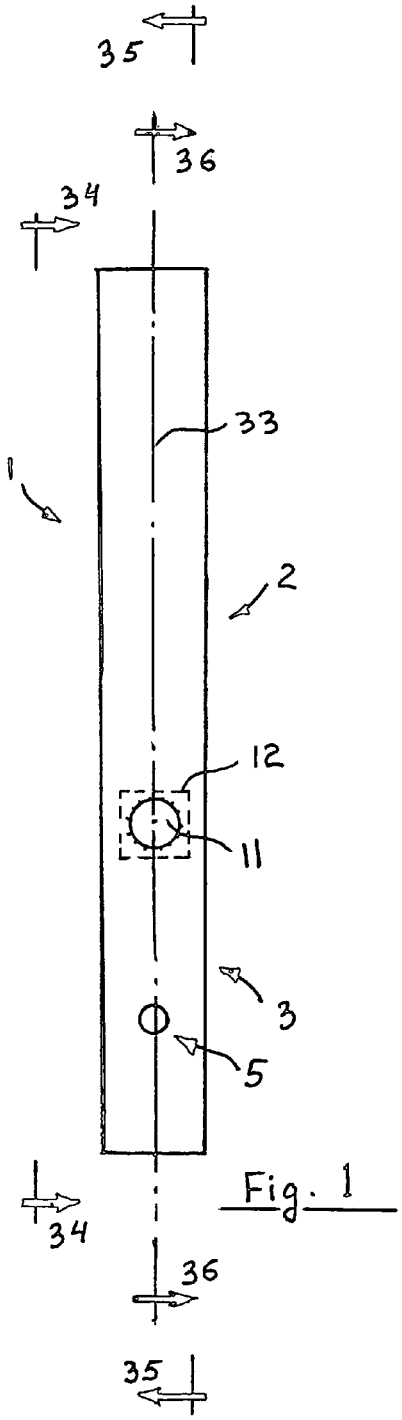
FIG. 1 is a simplified drawing of the improved hand-operated clapping percussion and rhythm device with controllable tone of sound.

1.—an improved hand-operated clapping percussion and rhythm device with controllable tone of sound;
2.—a blade portion;
3.—a handle portion;
4.—a tone of sound control means;
5.—a fastening means;
6.—a first blade;
7.—a second blade;
8.—a third blade;
9.—a fourth blade;
10.—a regulator;
11.—a head;
12.—a rest;
13.—a lower portion of the blade portion 2;
14.—a first aperture;
15.—a first grommet;
16.—a second grommet;
17.—an outer surface of the fourth blade 9;
18.—an outer surface of the first blade 6;
19.—a second aperture;
20.—a third aperture;
21.—a recess;
22.—a rivet;
23.—free;
24.—a nut;

25.—an upper portion of the blade portion 2;
26.—a free end of the first blade 6;
27.—a free end of the second blade 7;
28.—a free end of the third blade 8;
29.—a free end of the fourth blade 9;
30.—a slot;
31.—a clipping device;
32.—a knurling;
33.—an axis;
34-34—a left side view of the improved device without control means of the tone of sound;
35-35—a cross-section of the improved device without control means of the tone of sound and fastening means;
36-36—a cross-section of the improved device along the axis without control means of the tone of sound and fastening means;
37-37—a cross-section of the improved device 1;
38-38—the variants of the cross-sections of the blades' configuration;
39-39—a left side view of the improved device with the clipping means 31;
40-40—a cross-section of the improved device with the clipping means 31.

DETAILED DESCRIPTION OF THE INVENTION

With reference now to the drawings, and particularly to FIGS. 1-12C thereof, an improved hand-operated clapping percussion and rhythm device with controllable tone of sound embodying the principles and concepts of the present invention.

According to FIG. 1, the percussion and rhythm device 1 includes a blade portion 2 and a handle portion 3. The blade portion 2 comprises a tone of sound control means 4, and the handle portion 3 comprises a fastening means 5.

The improved percussion and rhythm device 1 includes a set (stack) of blades. As shown in FIGS. 2-8, the improved device 1 conditionally comprises four blades: a first blade 6, a second blade 7, a third blade 8 and a forth blade 9, but it is understandable that the percussion and rhythm device 1 can include any reasonable quantity of blades, for example, two blades (not shown) or three blades (not shown) or five blades (not shown), or more (not shown). Generalizing, the improved device 1 comprises at least two blades of a plurality of blades.

Figure 2:
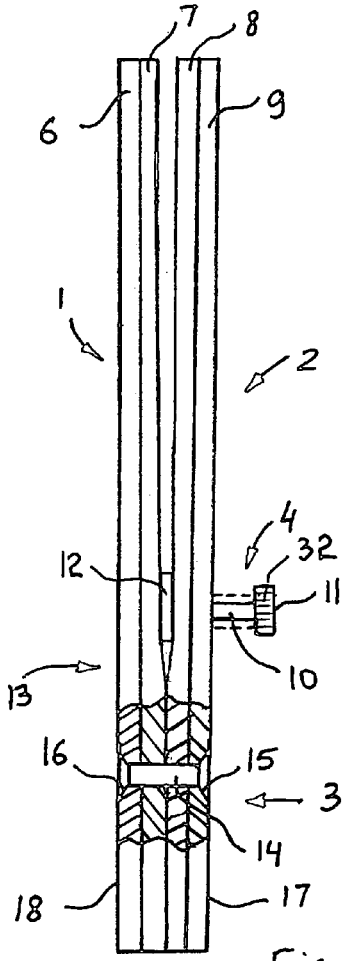
FIG. 2 is a simplified left side view 34-34 of the improved device without control means of the tone of sound.
Figure 3:
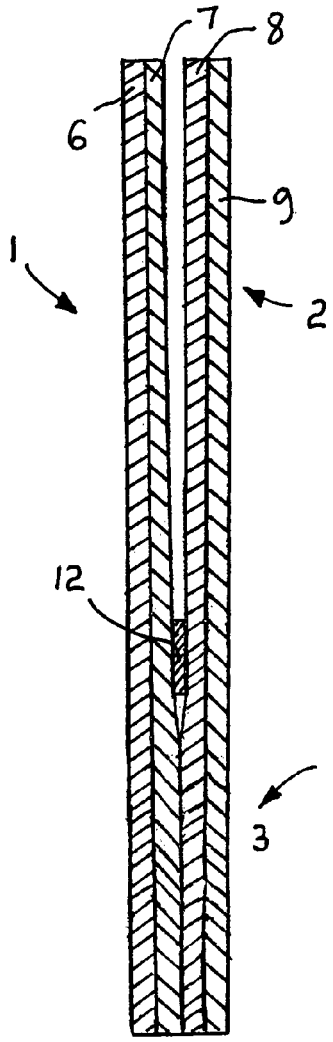
FIG. 3 is a simplified cross-section 35-35 of the improved device without control means of the tone of sound and fastening means.

Referring FIG. 2, the tone of sound control means 4 includes a regulator 10 with a head 11, and a rest 12. The rest 12 is located in the lower portion 13 of the blade portion 2 (see also FIG. 3). The rest 12 can be rigidly attached (e.g., glued, etc.) to the second blade 7 or can be tightly inserted in the recess 21 provided in the second blade 7 (see FIG. 10). The handle portion 3 comprises a first aperture 14 through all four blades. The first aperture 14 includes the first grommet 15 and the second grommet 16. the first grommet 15 is located in the outer surface 17 of the fourth blade 9, and the second grommet 16 is located in the outer surface 18 of the first blade 6.

Figure 4:
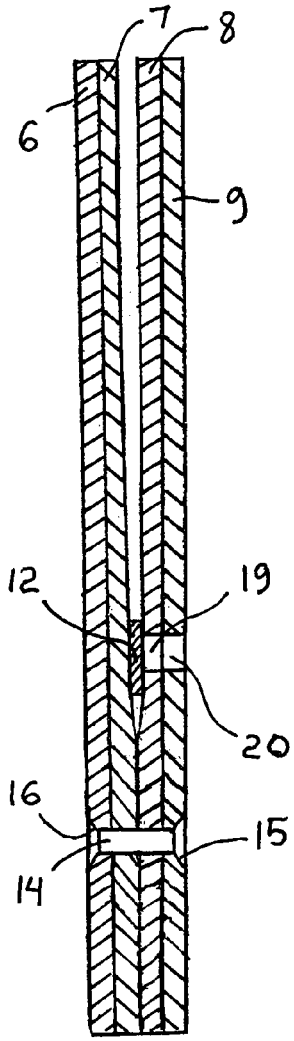
FIG. 4 is a simplified cross-section 36-36 of the improved device along the axis without control means of the tone of sound and fastening means.

FIG. 4 illustrates a cross-section along the axis 33 (FIG. 1). The third blade 8 comprises a second aperture 19, and the fourth blade 9 comprises a third aperture 20, as it is shown in FIG. 4.

Figure 5:
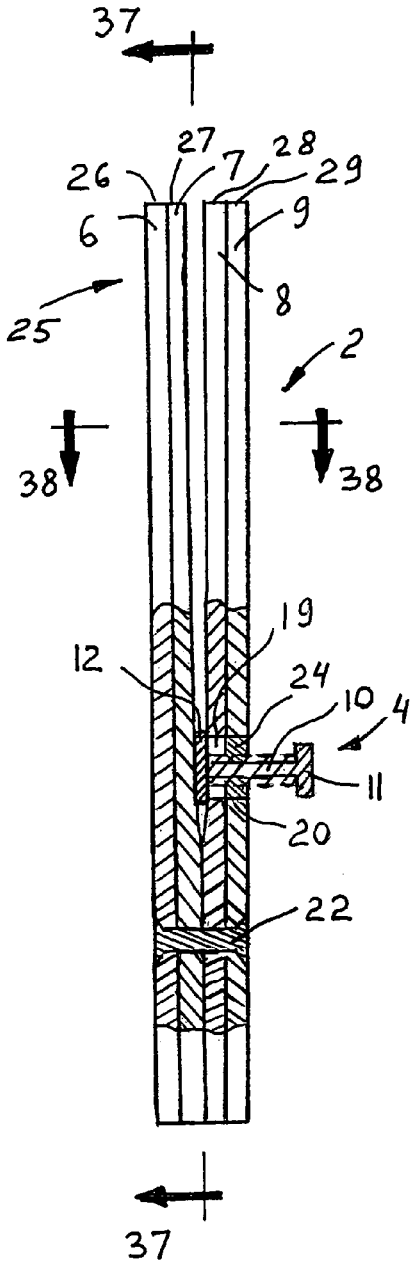
FIG. 5 is a simplified side view of the improved device along the axis with control means of the tone of sound and fastening means.

FIG. 5 shows the left side view of the improved device 1 wherein the blades 6, 7, 8 and 9 are rigidly secured together in the handle portion 3 by a single grommet fastening means, for instance, such as a rivet 22. It is preferred when the head of the rivet 22 should be flattened to the point where the blades remain in alignment when pivoted to a particular disposition.

It should be understandable, that the securing of the blades together can be provided by any other reasonable fastening means and principles, i.e.: by gluing the blades together in the area of the handle means 3, by welding (not shown), bolting (not shown), screwing (not shown), etc. without limitation. Also, it is understood, that the invention illustrates only one (single) rivet 22, but there can be used any reasonable quantity of the tightening means 5 (e.g., rivets, etc.) in the handle portion 3.

Figure 6:
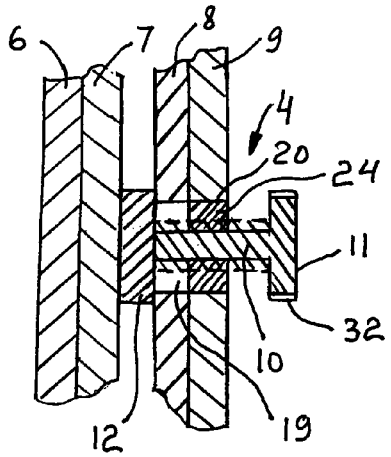
FIG. 6 is a simplified fragment of the side view of the improved device with the control means of the tone of sound in the initial position and with nut in the fourth blade.

FIG. 6 illustrates a zoomed fragment of the tone of sound control means 4 shown in FIG. 5.

As shown in FIG. 6, the nut 24 is inserted in the third aperture 20. The inserted (installed) nut 24 is rigidly connected to the wall of the third aperture 20 by the one of such manners, as: the gluing, welding (not shown) or rigidly fixed from the side by bolt (not shown) or screw (not shown), etc.

The improved hand-operated clapping percussion and rhythm device with controllable tone of sound operates as follows.

The blades 6, 7, 8 and 9 are freely extend in their lower portion 3 of the device 1 from the handle portion 3 of the device 1, where the blades are rigidly tightened together by the grommet rivet 22 (see e.g., FIG. 5). In the upper portion 25 of the blade portion 2, the free ends 26, 27, 28 and 29 of the blades 6, 7, 8 and 9 respectively are free and can touch each other or not [for example, may have small gaps between each other (not shown)]. The blades 6-9 in the blade portion 2 can be of any reasonable cross-sectional configuration, for instance, as it is shown as the examples in FIGS. 12A, 12B and 12C, or of circular (semi-circular) configuration [not shown], etc. The curved blades in the blade portion 2 provide more strong (loud) and trembled sound during their operation.

Figure 13:
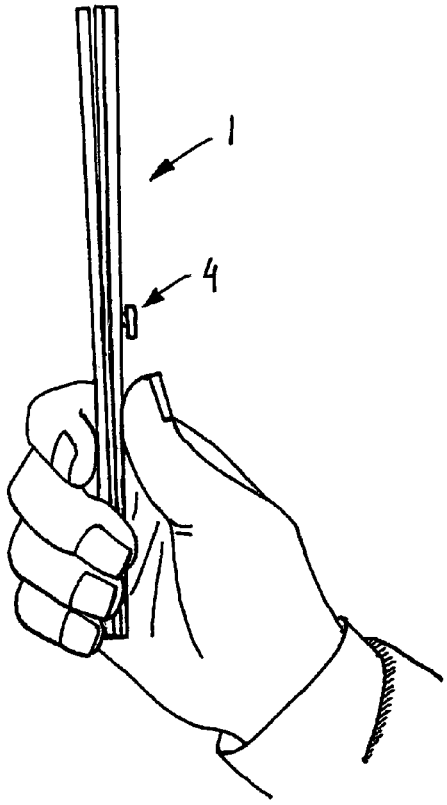
FIG. 13 is a simplified illustration of the hand-operated improved device.

The user, during operation of the improved device, holds the device for the handle portion 3 by one hand, as it is illustrated in FIG. 13 and strikes the upper portion 25 of the blade portion 2 of the device 1 against his another hand, leg, or against a chair or other object. At the time of device striking, the outer blades (e.g., first 6 and fourth 9 blades) are aligned juxtaposed to the anvil blades (e.g., second 7 and third 8 blades respectively) and percussively struck onto the anvil blades. Thus, the percussion and/or rhythm musical sound is produced as adjacent blades strike each other.

Figure 9:
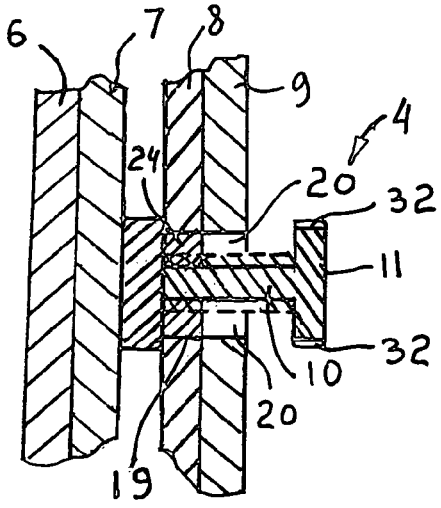
FIG. 9 is a simplified fragment of the side view of the improved device with the control means of the tone of sound in the initial position and with nut in the third blade.

In the initial position, the regulator 10 of the tone of sound control means 4 is in the position shown in FIGS. 5, 6 and 9, and the gaps between the blades 6-9 (and specifically between the blades 6-9 in the upper portion 25 of the blade portion 2) are in their natural (initial) dimensions, and the device 1 produces during operation the tone which can be produced in these initial position of the blades. The tone and strength of the produced sound depends on the length of the blade portion 2, material of the blades and configuration of the blades' surfaces (see FIGS. 12A, 12B and 12C).

Figure 7:
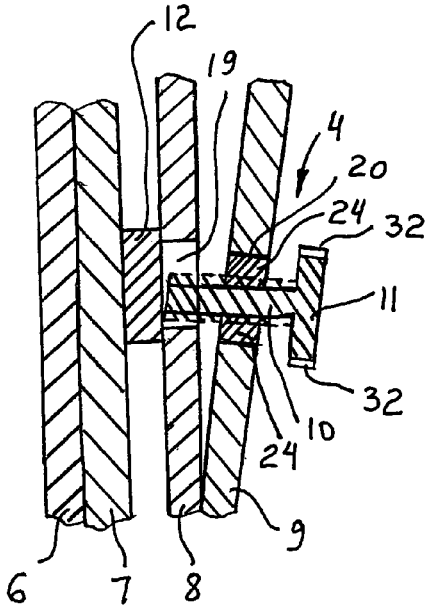
FIG. 7 is a simplified fragment of the side view of the improved device with the control means of the tone of sound in the adjusted position and with nut in the fourth blade.

As it is shown in FIGS. 5, 6 and 7, the nut 24 is located in the fourth blade 9. By the clockwise rotating of the head 11 of the regulator 10, the user (operator) loosens the third blade 8, which before was naturally sprang by the fourth blade 9, and increases the gap between the third blade 8 and fourth blade 9 in the area of the location of the tone of sound control means 4 (FIG. 7) and in the upper portion 25 of the blade portion 2, thereby, providing the different tone of the trembled sound during striking the improved device 1. For convenience head 11 can have, for example, a knurling 32 (FIGS. 2, 6, 7).

Figure 8:
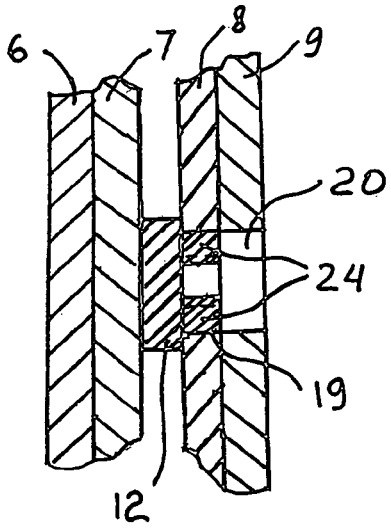
FIG. 8 is a simplified fragment of the side view of the improved device with the nut in the third blade.
Figure 10:
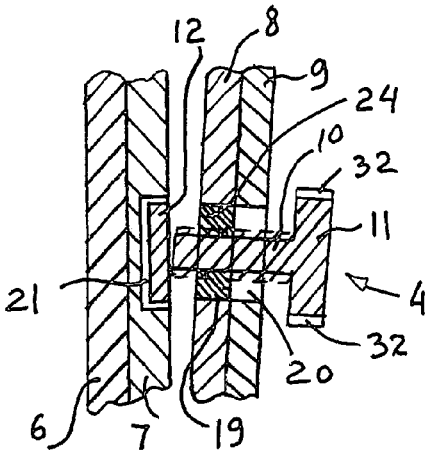
FIG. 10 is a simplified fragment of the side view of the improved device with the control means of the tone of sound in the adjusted position and with nut in the third blade.

As it is shown in FIGS. 8, 9 and 10, the nut 24 is located in the third blade 8. By the clockwise rotating of the head 11 of the regulator 10, the user (operator) increases the gap between the second blade 7 and third blade 8 in the area of the location of the tone of sound control means 4 (FIG. 10) and in the upper portion 25 of the blade portion 2, thereby, providing the different tone of the trembled sound during striking the improved device 1.

By rotating the head 11 of the regulator 10 in the counter-clockwise direction the user can return the regulator 10 (and thereby the gaps) in the device 1 initial position. The different positions of the regulator 10 in the nut 24 (which respond to the different gaps between appropriate blades) provide the different tones of the sound during striking of the device.

It is understandable, that the rest 12 can be located between first blade 6 and second blade 7 instead of between third 8 and fourth 9 blades, and the nut 24 can be appropriately located in the second blade 7 instead of in the third 8 or fourth 9 blades. Under this device's configuration, the regulator 10 increases the gaps between first blade 6 and second blade 7.

Figure 11:
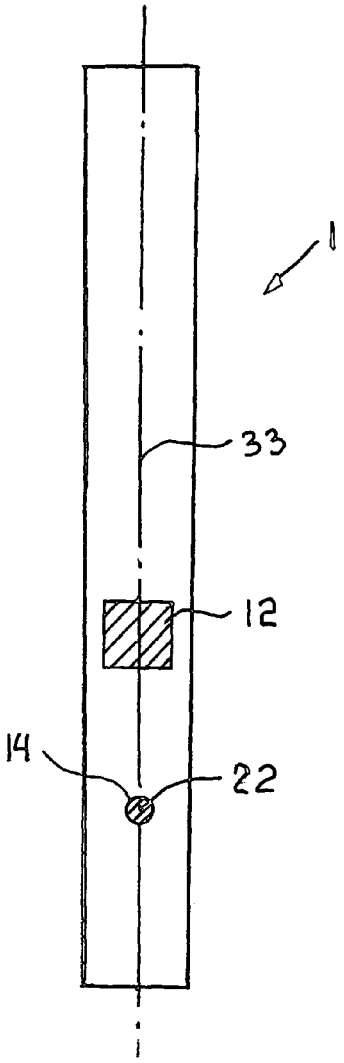
FIG. 11 is a simplified cross-section 37-37 of the improved device.
Figure 12A:
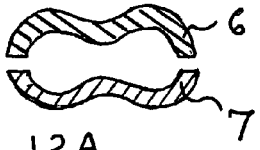
FIG. 12A is a simplified cross-section 38-38 of the blade's first configuration.
Figure 12B:
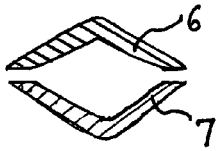
FIG. 12B is a simplified cross-section 38-38 of the blade's second configuration.
Figure 12C:
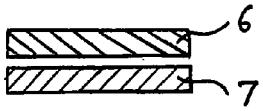
FIG. 12C is a simplified cross-section 38-38 of the blade's third configuration.

In FIG. 11, the rest 12 is shown of the rectangular form, but the rest 12 can be of any reasonable geometrical regular or irregular form and configuration, for example of the circular form (not shown), square form (not shown), triangular form (not shown), etc.

Figure 14A:
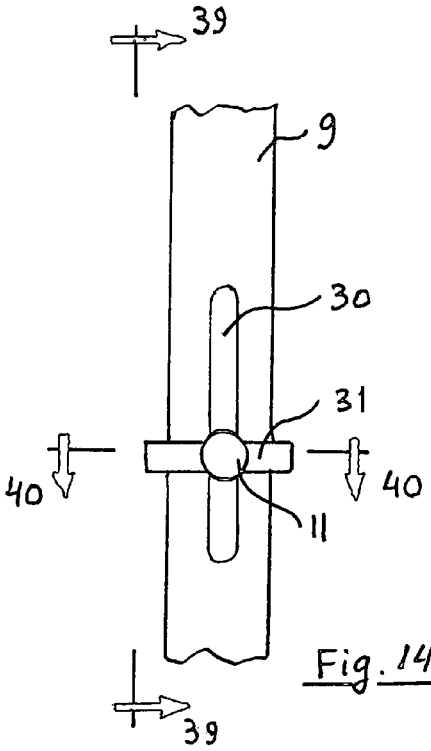
FIG. 14A is a simplified fragment of the hand-operated improved device with the clipping means.
Figure 14B:
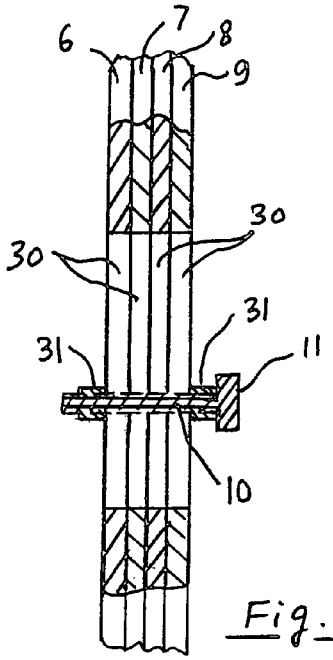
FIG. 14B is a simplified left side view 39-39 of fragment of the hand-operated improved device with the clipping means.
Figure 14C:
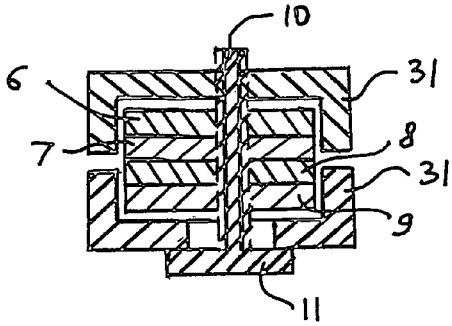
FIG. 14C is a simplified cross-section 40-40 of the hand-operated improved device with the clipping means.

Also, the improved device 1 can comprise the identical slot 30 (FIG. 14) in each blade instead of second 19 and third 20 apertures. The slots can be located in the same area of the lower portion 13 of the blade portion 2. The control of the tone of sound can be provided by the clipping means 31. The clipping means 31 of the tone of sound control means 4 can have different position along the slot, thereby limiting the free length "L" of the blades in the blade portion 2, by tightening clipping means 31 (using regulator 10, which can unobstructedly move along slot(s) 30). The shorter length "L", the "dryer" (less "colored") tremble tone of the sound. The longer length "L", the more "colored" tremble tone of the sound.

All components, parts, means can be made of any reasonably safe and non-hazardous material.

All sizes presented in the above illustrations and drawings are shown in the conditional dimensions, as example only, and can be of any reasonable and convenient sizes and configurations. For example, the blades can include the rounded ends, the outer surface 17 of the fourth blade 9 and the outer surface 18 of the first blade 6 can be decorated with the some pictures or ornaments, etc. The handle portion 3 can be covered by the covering means (not shown) with the rough outer surface (not shown) or texture (not shown) to prevent the hand sliding along the handle portion 3 during operating of the improved device 1.

The present invention may be embodied in other specific forms without departing from the spirit or essential attributes thereof and, accordingly, reference should be made to the appended claims, rather than to the foregoing specification as indicating the scope of the invention.

Accordingly the reader will see that, according to the invention, I have provided an improved hand-operated clapping percussion and rhythm device with controllable tone of sound. There has thus been outlined, rather broadly, the more important features of the invention. In this respect, it is understood that the invention is not limited in its application to the details of steps, construction and to the arrangements of the components set forth in the description and/or drawings. The invention is capable of other embodiments and of being practiced and carried out in various ways. Also, it is to be understood that the phraseology and terminology employed herein are for the purpose of description and should not be regarded as limiting.

While the above description contains many specificities, these should not construed as limitations on the scope of the invention, but as exemplification of the presently-preferred embodiments thereof. Many other ramifications are possible within the teaching to the invention. For example, an improved hand-operated clapping percussion and rhythm device with controllable tone of sound can be successfully used not only for producing of the different tones of the percussion and/or rhythm musical sounds, but also can be used as a noisemaker in the parades' and/or carnivals' presentations and entertainments.

As such, those skilled in the art will appreciate that the conception, upon which this disclosure is based, may readily be utilized as a basis for the designing of other structures, for carrying out the several purpose of the present invention. It is important, therefore, that the claims be regarded as including such equivalent constructions insofar as they do not depart from the spirit and scope of the present invention.

What is claimed is:

1. A hand-operated clapping percussion and rhythm device with controllable tone of sound comprising at least a first blade and a second blade of a plurality of blades rigidly connected to each other and including a handle portion, wherein a rigid connection of said at least first blade and a second blade of said plurality of said blades is occurred, including a fastening means, providing said rigid connection, comprising a first aperture located in a middle area of said handle portion;

a grommet rivet inserted in said first aperture and providing said rigid connection of said at least first blade and a second blade of said plurality of said blades;

a handle cover including a texture on an outer surface of said handle cover;

a blade portion, wherein said sound is produced by an upper portion of said at least first blade and a second blade of said plurality of said blades, comprising a tone of sound control means, providing the different tones of said sound, comprising a slot located in each blade in an area of a lower portion of said blade portion;

a clipping means including a regulator installed through said slot and unobstructedly moveable along said slot, wherein said clipping means provide a tightening of the blades to each other at any position along said slot, and wherein said tone of said sound produced by said hand-operated clapping percussion and rhythm device with controllable tone of sound is correlated with a length of the blades between said clipping means and free ends of the blades.

2. The device of claim 1, wherein said device further comprises at least said first blade with said slot, said second blade with said slot and a third blade of said plurality of said blades rigidly connected to each other, wherein said third blade includes identical slot in said area of said lower portion of said blade portion.

3. The device of claim 2, wherein said device further comprises at least said first blade with said slot, said second blade with said slot, said third blade with said slot and a fourth blade of said plurality of said blades rigidly connected to each other, wherein said fourth blade includes identical slot in said area of said lower portion of said blade portion.

* * * * *